US007640611B1

(12) United States Patent
Kluft

(10) Patent No.: US 7,640,611 B1
(45) Date of Patent: Jan. 5, 2010

(54) MATTRESS DESIGN

(76) Inventor: Earl S. Kluft, 1701 Lexington Rd., Beverly Hills, CA (US) 90210

( * ) Notice: Subject to any disclaimer, the term of this patent is extended or adjusted under 35 U.S.C. 154(b) by 0 days.

(21) Appl. No.: 11/042,678

(22) Filed: Jan. 25, 2005

(51) Int. Cl.
*A47C 27/00* (2006.01)

(52) U.S. Cl. ..... 5/716; 5/718; 5/740

(58) Field of Classification Search ..... 5/716, 5/718, 720, 740, 737–738
See application file for complete search history.

(56) References Cited

U.S. PATENT DOCUMENTS

| | | | | |
|---|---|---|---|---|
| 681,124 | A | | 8/1901 | Lally |
| 1,432,875 | A | | 10/1922 | Lavagetto |
| 1,873,607 | A | | 8/1932 | Lafevre |
| 1,986,255 | A | | 1/1935 | Durfey et al. |
| 2,002,157 | A | | 5/1935 | Reed |
| 2,154,910 | A | | 4/1939 | Magaril |
| 2,610,334 | A | | 9/1952 | Piliero |
| 2,675,566 | A | | 4/1954 | Lieberman |
| 2,709,819 | A | | 6/1955 | Wise |
| 2,755,215 | A | | 7/1956 | Talalay et al. |
| 2,862,214 | A | * | 12/1958 | Thompson et al. ..... 5/720 |
| 3,032,782 | A | | 5/1962 | Sharfe et al. |
| 3,148,387 | A | | 9/1964 | Sarnie, Jr. et al. |
| 3,242,505 | A | | 3/1966 | Tyhanic |
| 3,502,316 | A | | 3/1970 | Saether |
| 3,596,299 | A | | 8/1971 | Klicki |
| 3,636,574 | A | | 1/1972 | Kramer |
| 3,722,013 | A | | 3/1973 | Surletta |
| 3,822,426 | A | | 7/1974 | Mistarz |
| 3,846,857 | A | | 11/1974 | Weinstock |
| 3,848,283 | A | | 11/1974 | Ikeda |
| 3,855,653 | A | | 12/1974 | Stalter |
| 4,286,344 | A | | 9/1981 | Ikeda |
| 4,324,011 | A | | 4/1982 | Cavaler |
| 4,326,311 | A | | 4/1982 | Paipovich |
| 4,369,534 | A | | 1/1983 | Wright |
| 4,429,427 | A | * | 2/1984 | Sklar ..... 5/654.1 |
| 4,449,261 | A | * | 5/1984 | Magnusson ..... 5/722 |
| 4,476,595 | A | | 10/1984 | Ikeda |
| 4,607,402 | A | | 8/1986 | Pollard |
| 4,662,011 | A | | 5/1987 | Duvivier |
| 4,794,658 | A | * | 1/1989 | Goodale ..... 5/737 |
| 4,872,228 | A | | 10/1989 | Bishop |
| 4,975,996 | A | | 12/1990 | Evans et al. |
| 4,980,940 | A | | 1/1991 | Isshiki |
| 5,027,459 | A | | 7/1991 | Perry, Jr. et al. |
| 5,040,255 | A | * | 8/1991 | Barber, Jr. ..... 5/720 |
| 5,210,890 | A | | 5/1993 | Hagglund |
| 5,222,264 | A | | 6/1993 | Morry |
| 5,239,715 | A | | 8/1993 | Wagner |
| 5,513,401 | A | | 5/1996 | Abe et al. |
| 5,537,699 | A | | 7/1996 | Bonaddio et al. |

(Continued)

FOREIGN PATENT DOCUMENTS

| | | |
|---|---|---|
| CA | 502156 | 5/1954 |

(Continued)

*Primary Examiner*—Fredrick Conley
(74) *Attorney, Agent, or Firm*—Fulwider Patton LLP

(57) ABSTRACT

A mattress embodying a foam encasement surrounding individually wrapped coils and lacking a barrier separating upholstery layers from the coil assembly. Border material is affixed to sidewalls forming the foam encasement and the upholstery layer is tacked to a base of the foam encasement.

15 Claims, 6 Drawing Sheets

U.S. PATENT DOCUMENTS

| | | | | |
|---|---|---|---|---|
| 5,704,085 | A | 1/1998 | Sabalaskey | |
| 5,724,686 | A * | 3/1998 | Neal | 5/717 |
| 6,223,370 | B1 | 5/2001 | Kluft | |
| 6,249,924 | B1 | 6/2001 | Kluft | |

FOREIGN PATENT DOCUMENTS

| | | |
|---|---|---|
| CA | 630944 | 11/1961 |
| FR | 439165 | 6/1912 |
| GB | 534679 | 3/1941 |

* cited by examiner

MATTRESS DESIGN

BACKGROUND OF THE INVENTION

The present invention relates generally to mattress construction. More particularly, the present invention relates to a mattress including structure that minimizes a drum effect as well as a construction approach lending itself to the use of superior materials without significantly increasing the cost of making a luxury mattress.

In conventional mattresses for use as beds, it has been recognized that certain mattresses include structure creating an undesirable drum effect such that the sleeper does not benefit from mattress substructure but rather, sleeps on a drum-like surface. It has also been recognized that it is important to provide a mattress made from high quality raw materials so that the mattress maintains consistent resiliency across a sleeping surface and the tendency for the creation of permanent depressions is minimized.

Due to wear and tear, the surface of a conventional mattress might sag, shift, lose its form, etc. A sleeper lying on the mattress might inadvertently roll off the mattress due to the lack of support at the sagging edge. To overcome such problems, there have been many approaches to mattress design.

Most improvements in the area of mattress design focus on the innerspring unit of the mattress. The innerspring unit is usually made from a plurality of spring coils arranged side-by-side in a rectangular matrix. A border made of metal wires encircling both the upper and lower surfaces frame the innerspring. The plurality of helical spring coils are positioned in a spaced apart relationship within the innerspring unit to provide the internal support for the mattress.

Some examples of mattresses using a modified innerspring unit include a pair of ridges formed on a sheet of elastomeric material that covers both sides of an innerspring unit. The elastomeric material is attached to the innersprings. Other approaches involve a border stabilizing and reinforcing member for use in mattresses. A plurality of rhomboid-shaped members of resilient material can be placed in the innerspring unit of a mattress between adjacent rows of springs. When placed as a beam between the springs, the rhomboid-shaped members improve firmness of the mattress.

Another approach involves a mattress border construction including a foam rail sleeve encasing a single row of coiled springs so that the top, bottom, and sides of the row of springs are surrounded by foam. Essentially, the coiled springs encased in the foam sleeve reinforce the border or edges of the innerspring unit giving it strength.

Moreover, in yet other approaches a mattress topper pad consisting of sheets of foam padding are provided wherein the soft foam is located in the middle of the sheet and the hard foam is located at the periphery or edges. Two or three of these sheets are laid on top of the innerspring unit.

Other conventional approaches involve including a bed guard comprising at least one elongated bolster assembled on top of a conventional mattress held in a position along one edge of the bed. A plurality of bolsters may be used on each edge of the bed for additional roll-off protection. Another design suggests using an array of pockets in which cylindrically shaped foam members are inserted to define a retainer structure enclosing a sleeping area on the mattress. Another conventional mattress design suggests using elastic foamed block inserts positioned into the void spaces left in the innerspring assembly at the periphery of the mattress. Other designs include a mattress topper pad and border stabilizer means for mattress innerspring units. The topper pad portion overlies the top or bottom of the coil innerspring unit while the border stabilizer portion is inserted between at least one convolution of each coil on the outside row of the coil innerspring unit to stiffen the spring action of the coils.

Certain of the conventional designs do not include a quilted, pillow top mattress. Such a mattress does not permit a top cover to move in from the edges of the mattress and therefore creates a drum effect. Consequently, the construction of the mattress works against itself in that a sleeper does not completely benefit from mattress substructure providing comfort and response to weight distribution (such as springs), but rather the sleeper lies upon a drum-like surface.

Further, conventional pillow-top mattresses typically include a gusset extending around a perimeter of the mattress. The gusset acts like a hinge which therefore allows the mattress cover to draw up about a sleeper. However, such conventional pillow-top mattresses require an extra layer of fabric between the mattress inner spring unit and the top upholstery which creates a drum effect within the body of the mattress. Although the drum effect is moved deeper within the mattress as compared to other conventional non-pillow top mattresses, the sleeper nevertheless does not completely benefit from the full comfort and functionality of the inner spring assembly. Another disadvantage of these conventional pillow-top mattresses is that they have become very thick (15-20 inches) in order to overcome the internal drum-like structure which makes it more difficult to find and fit sheets. Also, there exists a greater propensity for sagging mattresses and mattresses developing depressions.

Moreover, the multiple layers of upholstery or other materials included to create a barrier between bed springs and a sleeping surface adds to the material cost of a mattress. To offset material costs, manufacturers may select lower quality raw materials which do not stand the test of time. The undesirable permanent depressions can more readily form in the sleeping surface produced from the cheaper materials, which thus limits the life of a bed or at the very least, effects the long-term comfort of the bed.

Accordingly, there is a need for a mattress which both addresses the drum effect problem as well as provides a comfortable mattress having a long useful life. The present invention satisfies these and other needs.

SUMMARY OF THE INVENTION

Briefly, in general terms, the present invention is directed towards a mattress design embodying structure for optimizing comfort. Due to a novel construction approach, higher quality materials can be employed in the manufacture of commercial embodiments of the present invention.

In one particular embodiment, the mattress of the present invention lacks a taut or tension barrier between an inner spring assembly and upholstery layers forming a top surface of the mattress. The drum-like effect is minimized by the manner in which the border materials are affixed to the encasement of the mattress design.

In another aspect, the mattress includes a foam encasement that contains an inner spring assembly. Each spring of the inner spring assembly is individually wrapped and is capable of acting independently. Pockets or sleeves covering adjacent wrapped coils can be attached to each other. A border assembly extends about a perimeter of the foam encasement and includes an inner layer which is affixed directly to the encasement. The perimeter of an upper upholstery layer is attached to an upper end of the border assembly. Additionally, a plurality of fasteners are provided to connect the upper upholstery layer to the bottom portion of the foam encasement.

Without forces associated with pulling edges of the upper upholstery layer down to meet the perimeter of the mattress encasement, the mattress of the present invention is provided with a stable perimeter. The stability of the perimeter is further enhanced by the foam encasement arrangement. Such a stable perimeter results in minimizing any roll-off effect in that a sleeper can lie close to a mattress edge without being urged off the bed.

A higher category of materials can be used in the construction of the mattress of the present invention since fewer layers of upholstery are required to construct a comfortable and stable mattress. Better materials in turn provide the customer with a better product at a competitive price. Likewise, the life of the mattress can be increased as the formation of permanent impressions can be delayed or avoided through the use of superior raw materials.

Other features and advantages of the present invention will become apparent from the following detailed description, taken in conjunction with the accompanying drawings, which illustrate, by way of example, the principles of the invention.

DETAILED DESCRIPTION OF THE INVENTION

Figure 1:
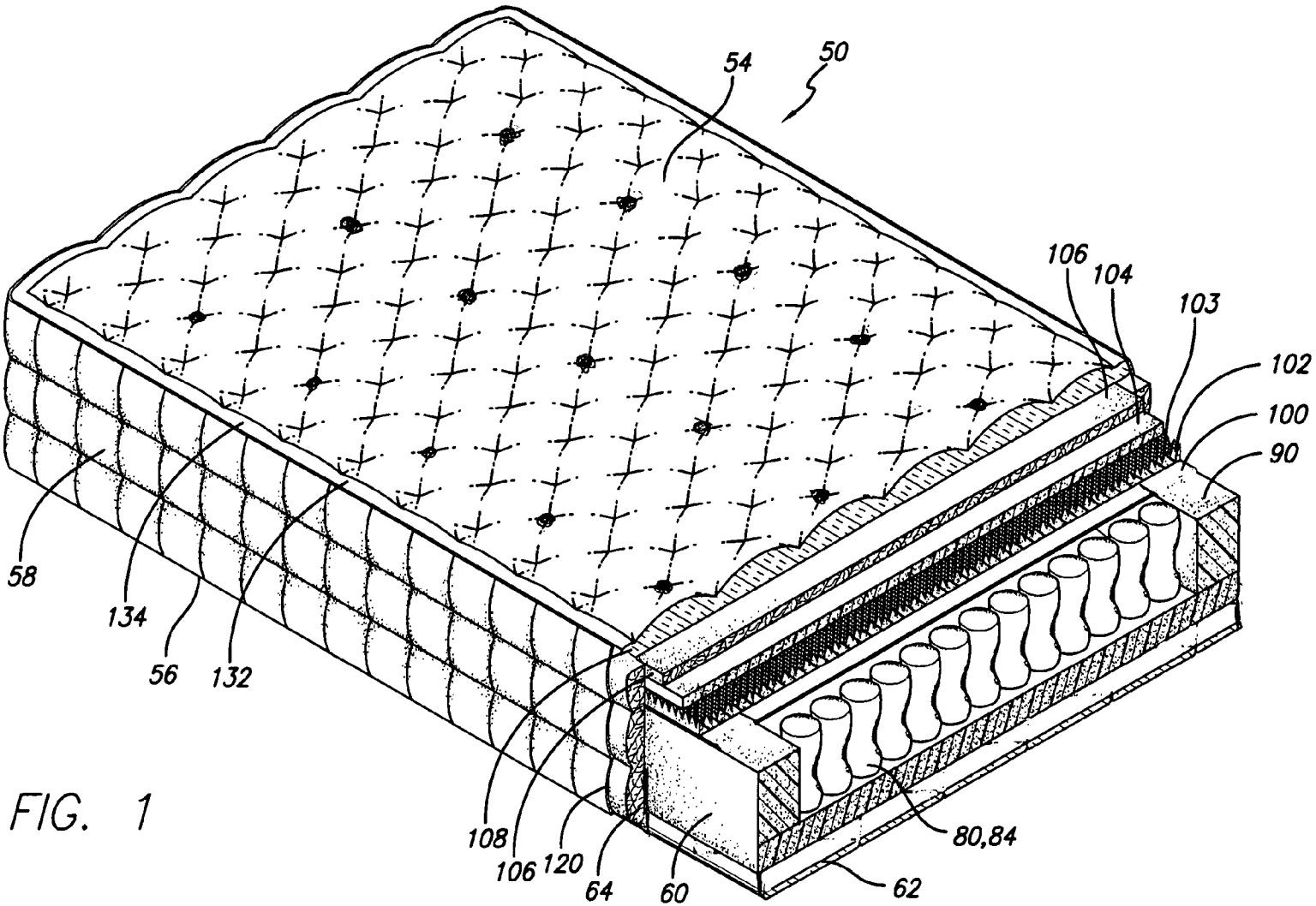
FIG. 1 is a perspective and partial cut-away view, depicting the various components of an assembled mattress of the present invention.

Referring now to the drawings, which are provided by way of example and not limitation, the present invention is embodied in a novel mattress design. The various components of the present mattress design are selected and assembled in a manner intended to provide a mattress of superior quality and which minimizes a drum effect found in conventional mattresses.

With reference to FIG. 1, there is shown a mattress 50 having an upper side or sleeping surface 54 and a lower or bottom side surface 56. The mattress further includes a perimeter consisting of sidewalls 58 extending vertically from the bottom surface 56 to thereby define a generally rectangular three dimensional mattress structure.

In one aspect, the mattress 50 includes a foam encasement 60 which forms an understructure of the bottom 56 and sidewalls 58 of the generally three-dimensional rectangular shape of the mattress 50. The foam encasement 60 can be made from various conventional materials such as polyurethane or other foams. Irrespective of the material, it is intended that the foam encasement 60 have a resilient and firm consistency to provide sufficient structure at the perimeter of the mattress to address the roll-off issue. Further, the foam encasement 60 can be formed from multiple components affixed to each other or can be constructed from a single piece of foam.

As shown in the Figures, the foam encasement 60 defines an open rectangular box. The foam encasement 60 includes a generally planar base 62 and two long, foam sidewalls 64 and a pair of short, foam sidewalls (not shown). The long sidewalls 64 are arranged parallel to each other and extend vertically from the base 62. The short sidewalls also extend vertically from the base and are attached or formed at right angles with respect to the long sidewalls 64. Thus, the sidewalls define a generally rectangular interior space for retaining other components of the mattress 50.

The interior of the foam encasement 60 is sized to receive an innerspring assembly, which can assume various conventional or other forms. In one embodiment, the innerspring assembly includes a plurality of coils 80 (see also FIGS. 2 and 3) arranged adjacently and extend vertically from the base 62 of the foam encasement 60. It is to be recognized that various embodiments and configurations of springs can be used as a coil 80. The coils 80 are contemplated to be individually wrapped in a sleeve 84 and to fill the entire interior of the foam encasement 60. Moreover, the coils 80 are contemplated to act independently to provide support to a sleeper. As such, the coils 80 can be aligned in laterally extending rows or columns or can be offset or nested as desired to provide an intended firmness of a particular consistency.

Figure 3:
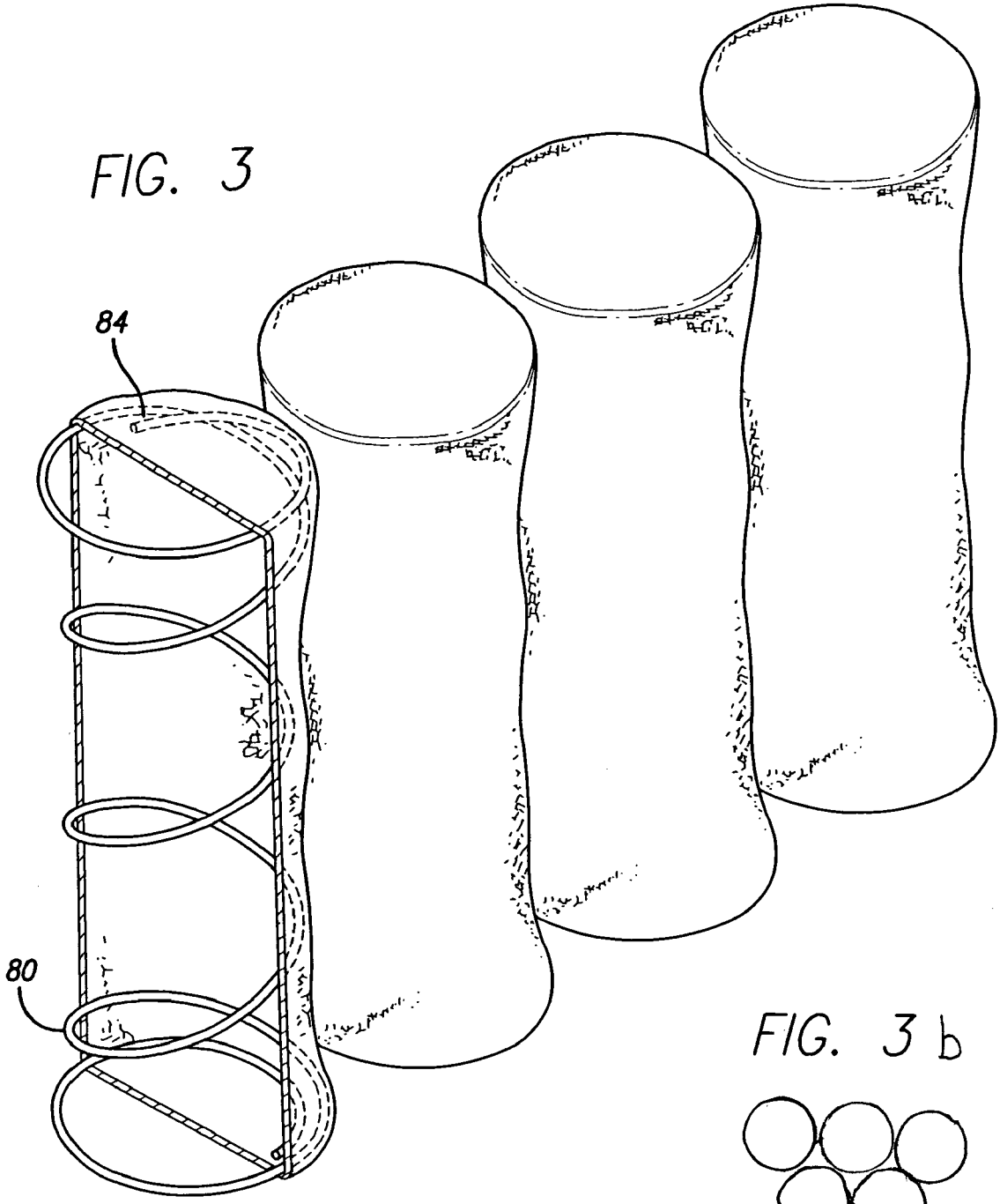
FIG. 3 is an enlarged and partial cut-away view, depicting components of the inner spring assembly.
Figure 3B:
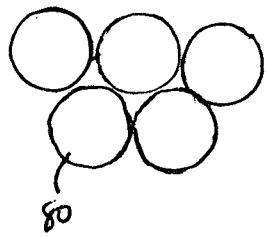
FIG. 3*b* is a top view, depicting nested coils.
Figure 3A:
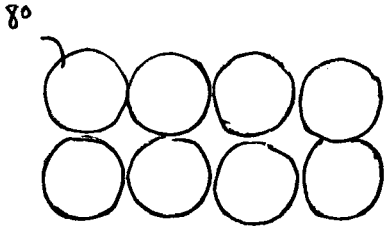
FIG. 3*a* is a top view, depicting coils aligned in rows and columns.

As shown in FIG. 3, all or a selected number of the independently wrapped coils 80 can be affixed to one or more adjacent coils. One approach to affixing adjacent coils is to glue or tie the sleeves 84 of one coil 80 to another wrapped coil 80. Again, by selectively connecting adjacent coil assemblies, a desired character or resiliency and spring force can be provided by the innerspring assembly. Moreover, as stated, the springs can be arranged in rows as depicted in FIG. 3*a* or can be arranged so that they are nested as shown in FIG. 3*b*. When in a nested configuration, the coils 80 form a substantially full blanket of coils 80 effectively spreading a load across a mattress surface wherein, the adjacent coils 80 act to provide lateral support to each other and to minimize the bending or tilting of a particular coil 80.

Referring again to FIG. 1, in one embodiment, the coils 80 can be made to extend vertically to substantially match or extend slightly higher than the height of the sidewalls 64. Placed directly on top of the spring assembly are various layers of rectangular material forming upholstery layers. Upholstery layers are sized to extend across an outer perimeter of the foam encasement 60 and over the interior 70 of the foam encasement 60. The upholstery layers are not, however, affixed to each other or pulled tight across the foam encasement 60. Therefore, a taut or rigid barrier is not formed across the interior 70 of the foam encasement 60. Rather, the peripheral ends of the layers lie over a top surface 90 of the sidewalls 64, 66. In this way, a drum effect is avoided and the roll-off issue is addressed.

A first thin, sheet layer 100 made from soft stretch knit material is placed adjacent and to overlay the wrapped coils 80. Lying on top of the sheet layer 100 is a first soft foam layer 102 made from latex polyurethanes or visco-elastic or slow recovery foam or cotton or polyester materials. The first soft foam layer 102 includes a generally planar bottom surface and a top surface including a plurality of undulating hills 103. Placed on top of the first soft layer 102 is a second layer 104 which is constructed from cotton or equivalent materials. On top of the second layer 104 is a latex foam or other upholstery material layer 106. Finally, a quilted panel 108 is placed on top of the wool layer 106.

The quilted panel layer 108 can include various layers of material such as high quality wool and is intended to define the surface upon which the bed sheets are placed. Quilted to an underside of the quilted panel layer 108 is a stretch knit fabric which functions to also eliminate any drum effect in that area. A similar quilted panel layer can be employed as a border assembly or side panels 120 which are intended to surround and encompass the sidewalls 64 of the foam encasement 60. Such material attached or extending from the sidewalls 120 is also contemplated to cover the base 62 of the foam encasement 60.

Figure 2:
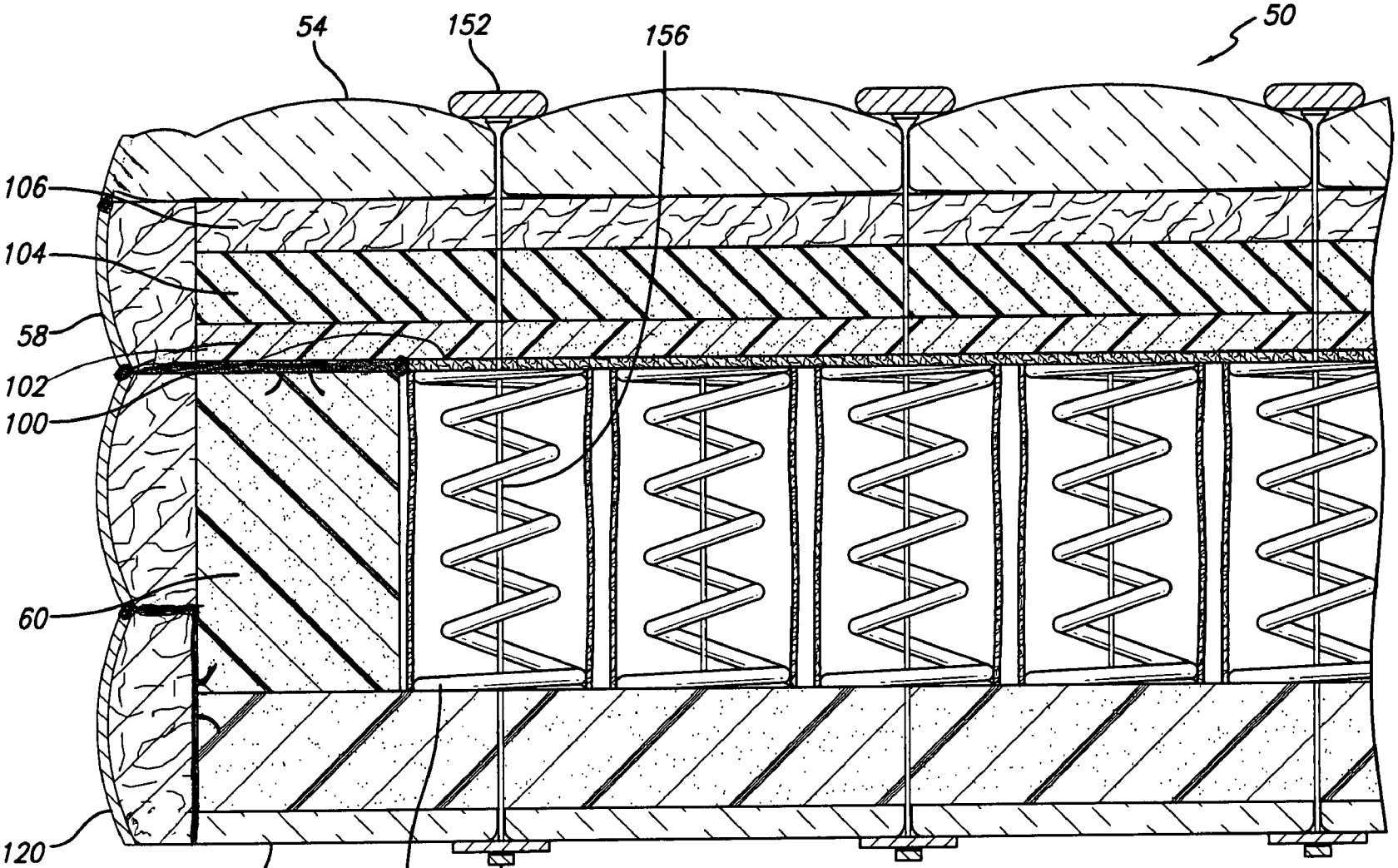
FIG. 2 is a cross-sectional view, taken along line 2-2 of FIG. 1.
Figure 5:
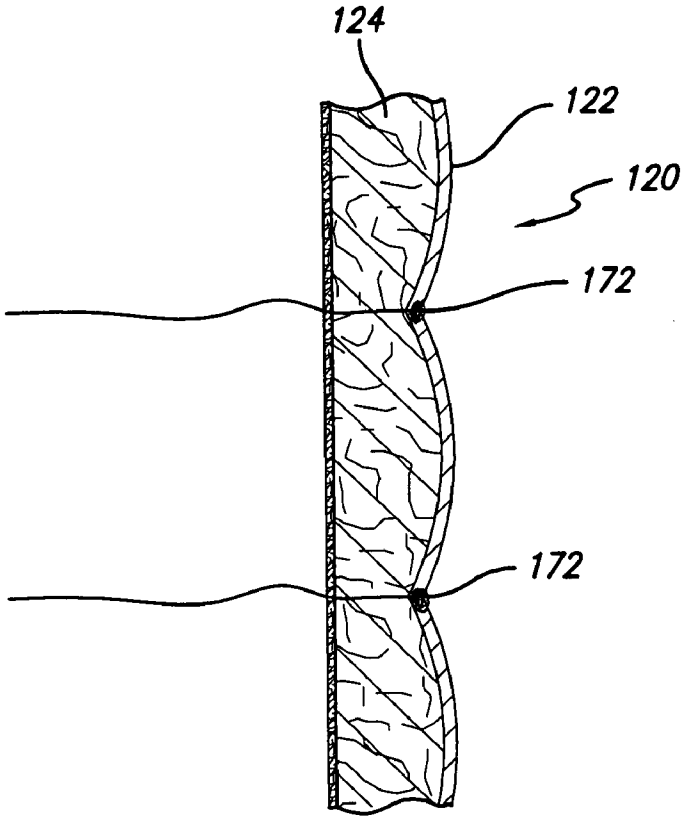
FIG. 5 is a cross-sectional view, depicting the components of FIG. 4 in assembled form.
Figure 4:
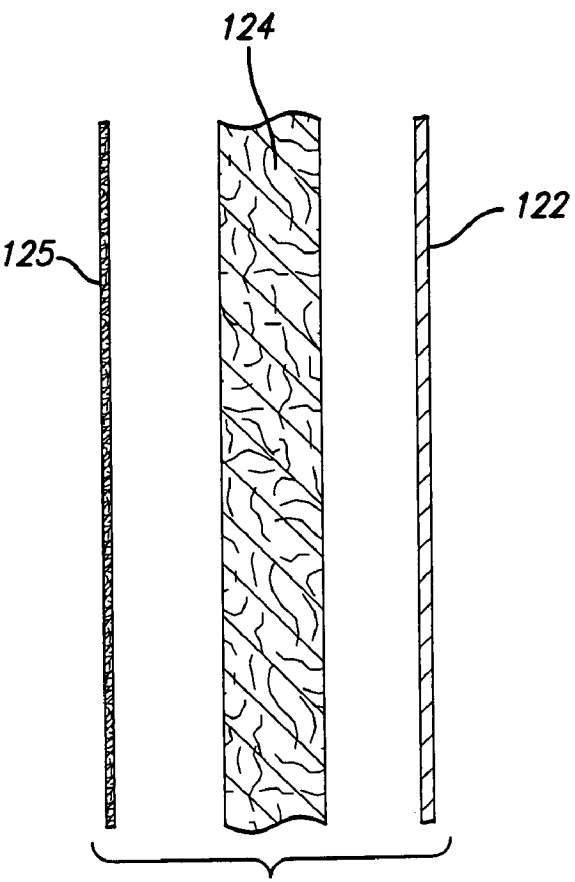
FIG. 4 as a cross-sectional view, depicting components of a border assembly.

Significantly, the border assembly 120 include a first outer layer 122, a second middle layer 124 and a third inner layer 125 (See FIGS. 2, 4, 5). These layers extend upwardly along the sidewalls 64. The second inner layer 124 is attached directly to a top surface 90 of the sidewall 64. The first layer 122 extends upwardly beyond the top surface 90 and includes a perimeter 132 that is attached by conventional means to a perimeter 134 of the quilted panel 108.

As shown in FIG. 2, the top surface 150 of the mattress 54 is anchored or tethered to the base or bottom 56 of the mattress. Although various approaches are contemplated, in one embodiment, a pair of buttons or tufts 152, 154, one residing on the top surface 54 and the other placed adjacent to the bottom surface 56 are connected by a lead 156. Incorporating a plurality of such structure into a mattress design can add to the overall stability of the mattress construction.

The overall design of the mattress 50 lends itself to the use of fewer but higher quality materials. Further, by employing fewer upholstery layers, conventional sheet covers fit better yet the comfort of the mattress is not compromised. In a contemplated embodiment, the mattress is on the order of 12-14 inches thick. Additionally, it is to be recognized that by avoiding applying downward tension on the upholstery layers, both the drum effect and roll-off can be minimized.

The mattress 50 of the present invention can be assembled in various stages. As shown in FIGS. 4 and 5, one stage of assembly involves forming the border assembly 120. The first fabric layer 122 and the second foam layer 124 are first sewn together. Next, the first and second layers are sewn to a polyester fiber and non-woven backing 125. At the same time, a flange 172 is sewn at a plurality of positions to complete the assembly of the border 120.

Figure 6:
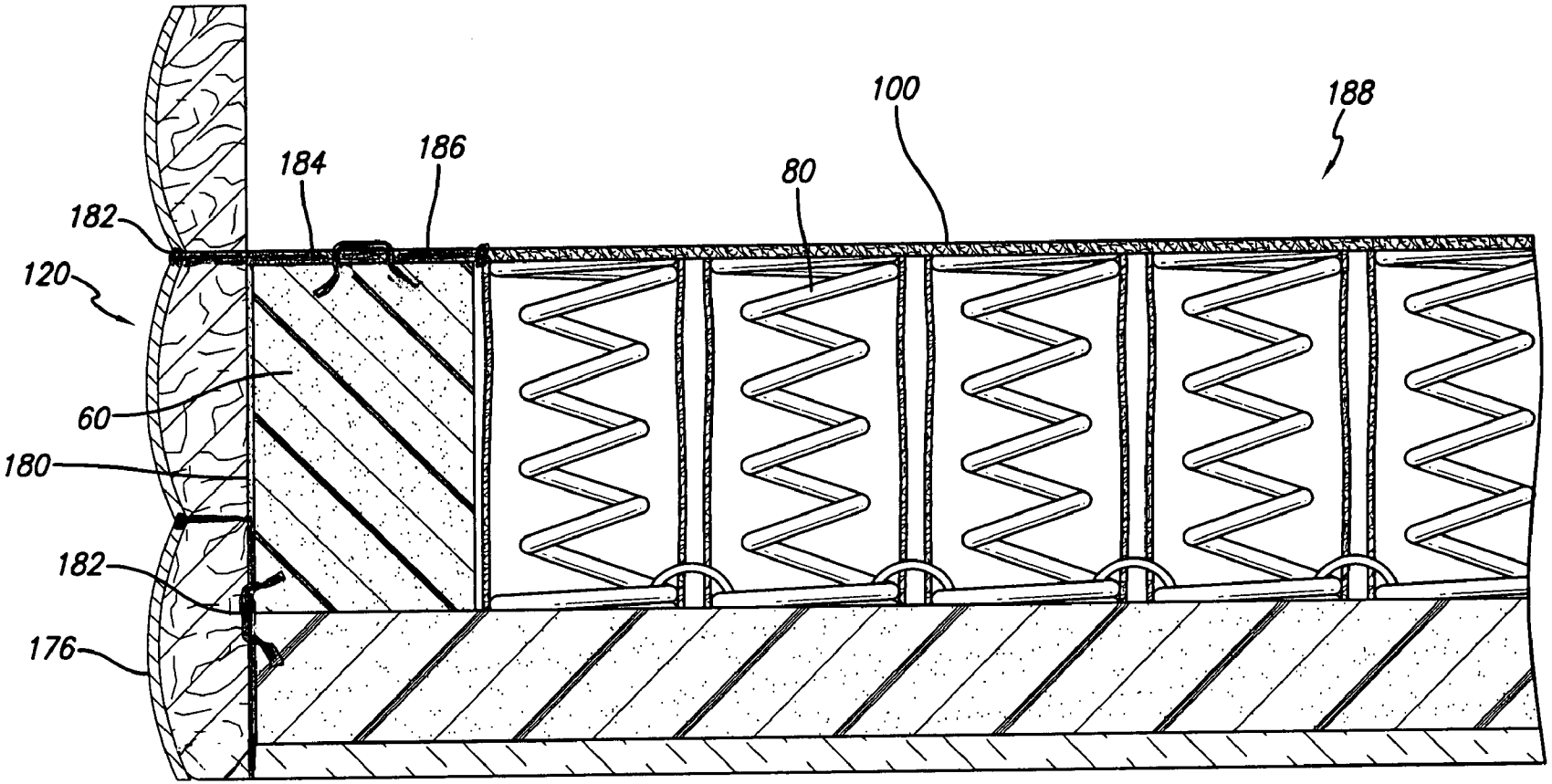
FIG. 6 is a cross-sectional view, depicting a mattress assembly including a border assembly attached thereto.

With reference to FIG. 6, the border assembly 120 is then attached to the foam encasement 60. A lower portion 176 of the border assembly 120 is attached to the encasement 60 at a first location 180 via gluing and or divergent staples 182. An upper portion 184 of the border assembly 120 is likewise attached via gluing and/or staples 182 to a second location 186 of the encasement 60. It is also to be recognized that the upper portion 184 of the border assembly 120 can be attached to a border wire (not shown) of a mattress unit.

Once the border assembly 120 is so attached to the foam encasement 60, a cavity 188 is created for filling with top layers of the mattress 50. Extending across a base of the cavity 188 is the sheet layer 100 of soft stretch knit material configured over the mattress unit including the spring assemblies 80. Due to the approach of design contemplated, this layer 100 of material need not be placed in tension which consequently facilitates the optimum performance of the springs 80. As such, the springs 80 are allowed to act independently being unconstrained by a fabric or other layer of material and thus, are permitted to react with greater flexibility and versatility to the distribution of weight across the mattress surface.

Figure 7:
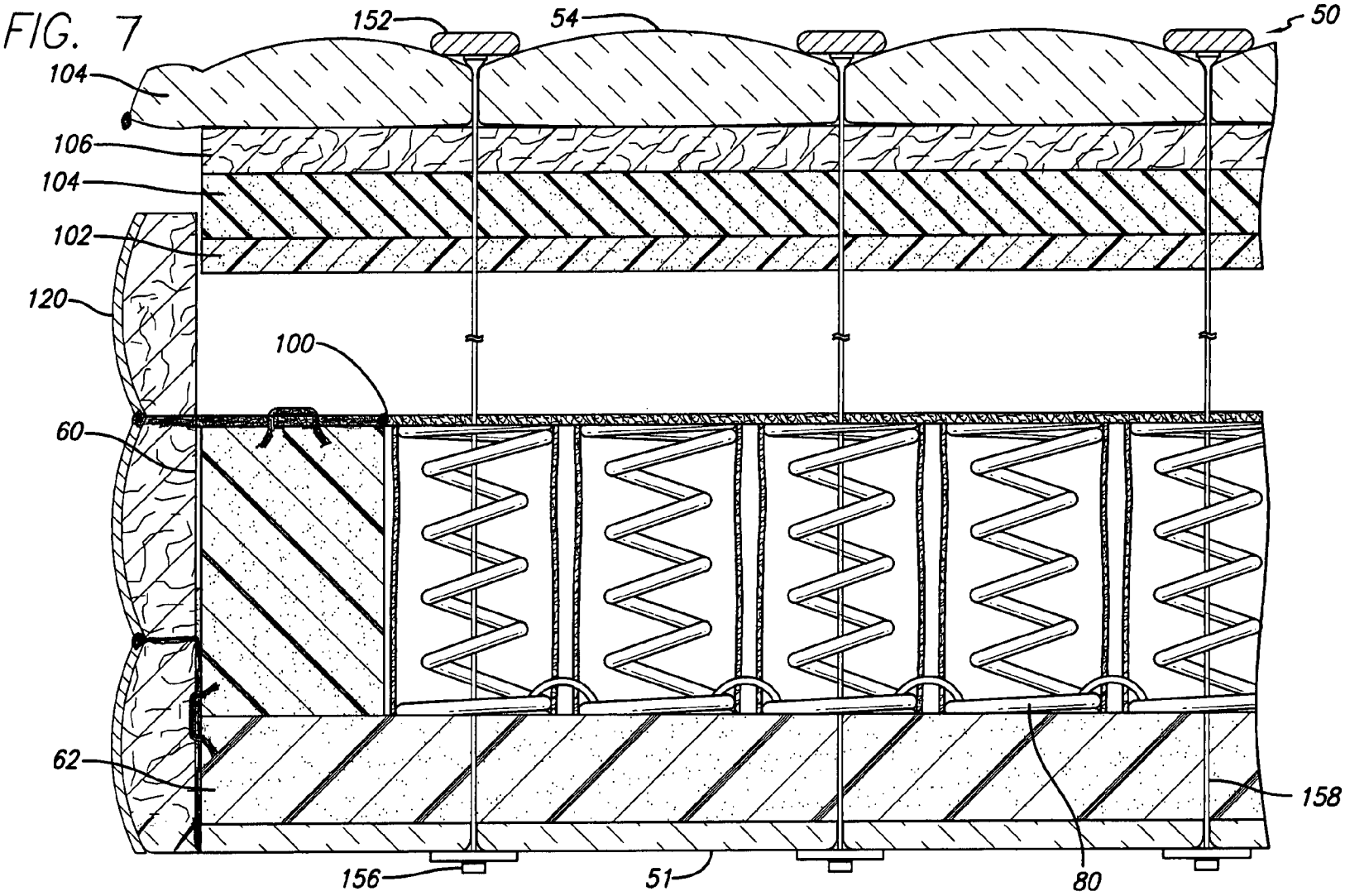
FIG. 7 is a cross-sectional view, depicting the mattress assembly of FIG. 6 receiving top layers of upholstery.

A final step of assembly involves filling the cavity 188 with the top layers 102, 104, 106 of the mattress assembly 50 (See FIG. 7). These layers are then tufted to the bottom 56 of the mattress using the button/tether 152, 154, 156 or equivalent anchoring arrangement. Moreover, edges of the quilted top layer 106 are sewn about the perimeter of the mattress to the border assembly 120 to thereby form a completed mattress assembly 50.

Thus, it will be apparent from the foregoing that, while particular forms of the invention have been illustrated and described, various modifications can be made without parting from the spirit and scope of the invention.

We claim:

1. A mattress assembly, comprising:

an encasement including a base and a plurality of side walls joined together to define an interior cavity, each sidewall having an interior surface, a top surface and an outer surface, the outer surface of the sidewalls defining a perimeter of the encasement;

an innerspring unit having a top surface and comprising multiple springs contained within the interior cavity of the encasement;

a border assembly attached to, and extending about, the perimeter of the encasement, the border assembly having an upper end portion extending above the top surfaces of the sidewalls; and an upholstery assembly layer lying only within the border assembly, and extending from the top surface of one sidewall to the top surface of the other sidewalls and comprising a) a first layer of material adjacent the top surface of the innerspring unit and b) at least one additional overlying layer, wherein none of said layers of material are placed in tension and the springs of the innerspring unit react independently of each other in response to the weight of a person, without the constraints of the upholstery assembly layer.

2. The mattress assembly of claim 1, further including fasteners located in the interior cavity which extend through the innerspring unit and upholstery assembly layer and are attached to the base of the encasement.

3. The mattress assembly of claim 1, wherein the springs of the innerspring unit are individually wrapped in a sleeve.

4. The mattress assembly of claim 1, wherein a quilted panel overlays the upholstery assembly layer.

5. The mattress assembly of claim 1, wherein the border assembly includes a a plurality of flanges fixedly attached to the sidewalls but not to the plurality of springs.

6. The mattress assembly of claim 1, wherein the upholstery assembly layer is formed from multiple layers of materials attached together.

7. The mattress assembly of claim 6, wherein the multiple layers are selected from a group of materials comprising foam and cotton.

8. The mattress assembly of claim 7, wherein the layers making up the upholstery assembly layer includes a sheet layer made from a knit material, a second layer made from foam above the sheet layer and a third layer made from cotton extending above the second layer.

9. The mattress assembly of claim 8, wherein a quilted panel overlays the third layer.

10. The mattress assembly of claim 1, wherein the encasement is made from foam.

11. The mattress assembly of claim 1, wherein the border assembly is made from a quilted panel.

12. A mattress assembly, comprising:

a foam encasement including a base and a plurality of sidewalls, each sidewall having a height and a top surface, the sidewalls and the base defining an interior cavity of the encasement;

a plurality of springs contained within the interior cavity of the foam encasement, each of the springs extending vertically from the base for a distance substantially equal to the height of the sidewalls;

a layer of stretch knit material extending, without tension, over the plurality of springs;

an upholstery assembly layer extending across the layer of stretch knit material and the top surface of the sidewalls, wherein the portion of the upholstery assembly layer which extends over the top surface of the sidewalls lays, without tension, over the top surface of the sidewalls;

a quilted panel layer extending over the upholstery assembly layer;

a border assembly attached to the sidewalls of the foam encasement to form a perimeter, a top portion of the border assembly being fastened to the peripheral edge of the quilted panel layer, the upholstery assembly layer being sized to fit within the perimeter defined by the border assembly; and a plurality of fasteners located in the interior cavity of the foam encasement, each fastener being attached to the base of the foam encasement and extending through the quilted panel layer, the upholstery assembly layer and the layer of stretch knit material, wherein the springs react independently of each other in response to the weight of a person, without the constraints of the upholstery assembly layer.

13. The mattress assembly of claim 12, wherein the border assembly has a height which is greater than the height of the sidewalls, the top portion of the border assembly forming a second interior cavity extending above the tops of the sidewalls and the plurality of springs, wherein the upholstery assembly layer is housed within this second interior cavity.

14. The mattress assembly of claim 12, wherein the border assembly is made from a quilted panel layer.

15. The mattress assembly of claim 12, wherein the upholstery assembly layer is made from multiple layers including a first layer made from foam, a second layer made from cotton extending over the first layer and a third layer made from latex foam extending over the second layer.

* * * * *